US007413516B2

(12) United States Patent
Habing

(10) Patent No.: US 7,413,516 B2
(45) Date of Patent: Aug. 19, 2008

(54) TEETER-TOTTER

(75) Inventor: Theodore G. Habing, Tustin, CA (US)

(73) Assignee: Dream Visions, LLC, Tustin, CA (US)

( * ) Notice: Subject to any disclaimer, the term of this patent is extended or adjusted under 35 U.S.C. 154(b) by 0 days.

(21) Appl. No.: 11/177,255

(22) Filed: Jul. 8, 2005

(65) Prior Publication Data

US 2006/0128482 A1 Jun. 15, 2006

Related U.S. Application Data

(63) Continuation-in-part of application No. 29/214,790, filed on Oct. 7, 2004, now Pat. No. Des. 512,746, which is a continuation-in-part of application No. 29/214,815, filed on Oct. 7, 2004, now Pat. No. Des. 512,747, which is a continuation-in-part of application No. 29/214,810, filed on Oct. 7, 2004, now Pat. No. Des. 541,881, which is a continuation-in-part of application No. 29/214,814, filed on Oct. 7, 2004.

(51) Int. Cl.
*A63G 11/00* (2006.01)

(52) U.S. Cl. ..... 472/106; 472/112; 472/113

(58) Field of Classification Search ..... 472/106–113, 472/115, 136

See application file for complete search history.

(56) References Cited

U.S. PATENT DOCUMENTS

| | | | | | |
|---|---|---|---|---|---|
| 124,262 | A | * | 3/1872 | Fowler | 472/113 |
| 654,779 | A | | 7/1900 | Bowland | |
| 1,420,787 | A | | 6/1922 | Thomas | |
| 1,429,289 | A | | 9/1922 | Maxwell et al. | |
| 1,437,888 | A | * | 12/1922 | Davis | 472/113 |
| 1,543,619 | A | | 6/1925 | Pryor | |
| 1,553,418 | A | | 9/1925 | Watts | |
| 1,659,735 | A | | 2/1928 | Jamison | |
| 1,714,247 | A | * | 5/1929 | Smedley | 472/125 |
| 1,746,260 | A | | 2/1930 | Kenney | |
| 1,866,906 | A | | 7/1932 | Rager | |
| 1,952,548 | A | | 3/1934 | Hayes | |
| 2,092,993 | A | | 9/1937 | Tinker | |
| 2,222,119 | A | * | 11/1940 | Overholt | 482/35 |
| 2,247,533 | A | * | 7/1941 | Twist | 472/111 |
| 2,471,572 | A | | 5/1949 | Loker | |
| 2,488,889 | A | * | 11/1949 | Allie | 472/112 |
| 2,545,295 | A | | 3/1951 | Miller | |
| 2,616,485 | A | | 11/1952 | Robbins | |
| 2,648,538 | A | * | 8/1953 | Robbins | 482/36 |
| 2,685,915 | A | * | 8/1954 | Hannas | 472/108 |
| 2,701,604 | A | | 2/1955 | St. Louis | |
| 2,738,831 | A | | 3/1956 | Sage | |
| 3,051,481 | A | | 8/1962 | Johnson | |
| 3,311,373 | A | | 3/1967 | Phillips | |
| 4,226,411 | A | * | 10/1980 | Manus | 472/110 |
| 4,570,928 | A | | 2/1986 | Smith | |

* cited by examiner

*Primary Examiner*—Kien Nguyen
(74) *Attorney, Agent, or Firm*—Blakely, Sokoloff, Taylor & Zafman, LLP

(57) ABSTRACT

A teeter-totter is constructed with a pair of seats mounted at opposite ends of a rocker beam. The seats, when aligned horizontally, are below the pivot point so as to provide a pendular component of motion. The pivot is supported on an overhead framework and the rocker beam is suspended below the pivot to eliminate the pinch points found in conventional teeter-totter designs. A counterbalance mechanism may be incorporated so that users of different weights remain in balance while operating the teeter-totter.

18 Claims, 2 Drawing Sheets

TEETER-TOTTER

RELATED APPLICATIONS

This application is a continuation-in-part of application Ser. Nos. 29/214,790 now U.S. Pat. No. D,512,746; 29/214,815 now U.S. Pat. No. D,512,747; 29/214,810 now U.S. Pat. No. D,541,881; and 29/214,814, all of which were filed on Oct. 7, 2004.

BACKGROUND OF THE INVENTION

1. Field of the Invention

This invention relates generally to the field of playground equipment and, more particularly, to an improved teeter-totter or seesaw.

2. Background

Teeter-totters (also referred to as seesaws) have been popular with children since before recorded history. In its simplest form, a teeter-totter may be constructed by merely placing a board over an object to serve as a fulcrum or pivot. Modern day playground teeter-totters are essentially the same, although the structural members are more typically steel for improved durability. Thus, a typical playground teeter-totter comprises a beam supported off the ground by a horizontal support member. The beam is coupled to the support member with a simple pivot assembly and has a seat mounted at each end thereof. Children in the seats experience generally up and down motion when playing on a teeter-totter.

Another popular piece of playground equipment is the swing. In its most common form, a swing comprises a seat suspended by chains or other flexible members from an overhead support. Children playing on a swing experience a generally to and fro motion in an arc about the overhead pivot.

Various attempts have been made to combine the motions of a conventional teeter-totter and a swing. Devices of this type are shown, for example, in U.S. Pat. Nos. 1,659,735; 1,714,247; and 1,746,260, among others. These prior art devices, however, have a number of disadvantages, including lack of stability and the presence of pinch points, making such devices hazardous for children.

SUMMARY OF THE INVENTION

The present invention provides an improved teeter-totter with a pair of seats mounted at opposite ends of a rocker beam. The seats, when aligned horizontally, are below the pivot point so as to provide a pendular component of motion. The pivot is supported on an overhead framework and the rocker beam is suspended below the pivot to eliminate the pinch points found in conventional teeter-totter designs. A counterbalance mechanism may be incorporated so that users of different weights remain in balance while operating the teeter-totter.

DETAILED DESCRIPTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
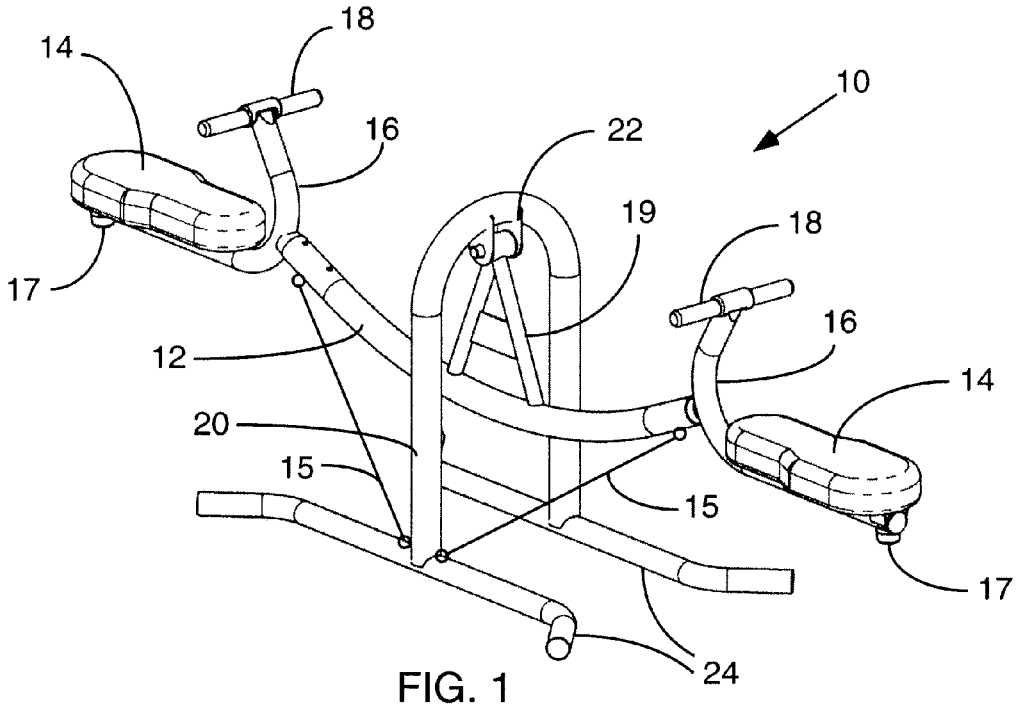
FIG. 1 is a perspective view of one embodiment of a teeter-totter in accordance with the present invention.

FIG. 1 is a perspective view of one embodiment of a teeter-totter in accordance with the present invention. A rocker beam 12 supports a pair of seats 14 on respective seat supports 16. Cushioned bumpers 17 may be placed under each seat to reduce impact with the supporting surface when the teeter-totter is in use. Handlebars 18 are provided to assist users in maintaining their balance while operating the teeter-totter. Means, such as cables 15, may be provided to lock the rocker beam in position and thus prevent unsupervised use of the teeter-totter.

Rocker beam 12 is suspended from support frame 20 by pivot 22. Member 19 couples the rocker beam to the pivot. Since the rocker beam is suspended well below the pivot, there are no dangerous pinch points. Support frame 20 includes a pair of upright members connected in an inverted "U" configuration and a pair of elongated base members 24 to support the teeter-totter on the ground or other supporting surface. The height of the support frame may be made adjustable by making the uprights of frame 20 telescopic or by making base members 24 rotatable so that the angled ends may be twisted to a down position and thereby raise the support frame.

The structural components of teeter-totter 10 may be formed of steel tubing as is conventional in the field of fitness and exercise equipment and may be protected with a powder-coated finish. Seats 14 may be made of a molded plastic for durability and weather resistance. Other suitable materials may be used and the invention is not limited in this regard.

Figure 2:
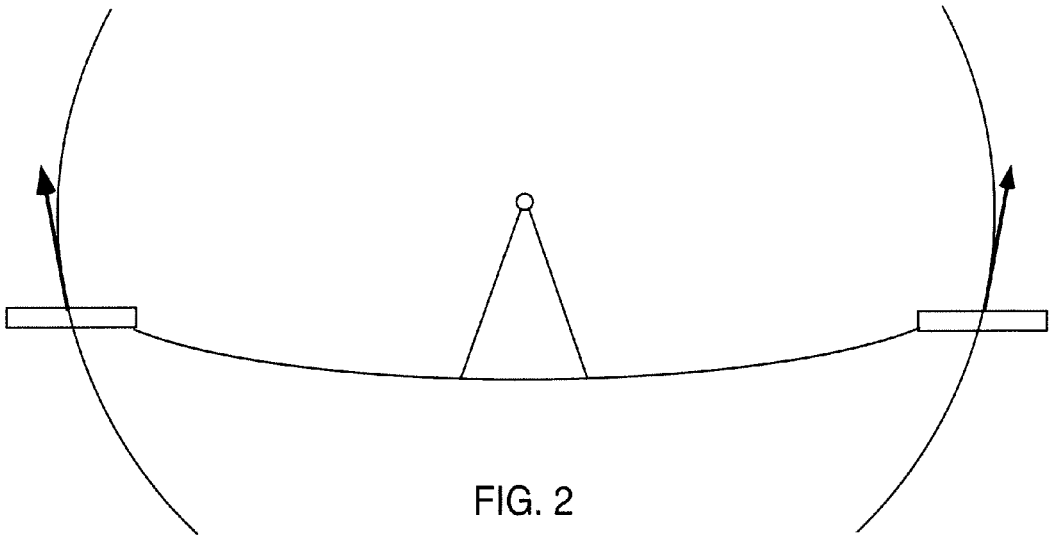
FIG. 2 illustrates a path of motion for one of the seats of the teeter-totter.

It should be observed that a horizontal line connecting seats 14 when the rocker beam is at rest lies below the level of pivot 22. This provides users of the teeter-totter with a component of pendular motion and provides a safer play experience since there is less tendency to catapult a user forward at the upper limit of travel. With reference to FIG. 2, each of the seats has a path of motion above and below the horizon of the pivot comprising an arc centered at the pivot. When the seats are aligned horizontally, the motion vector for the seat (tangent to the arc) is inclined with respect to vertical (i.e., there is a horizontal component of motion—away from the pivot when the seat is moving upward and toward the pivot when the seat is moving downward). As a result, the forward (toward the pivot) component of motion when the seat reaches its upper limit is less than it would be if the pivot were located at a lower elevation relative to the horizontal alignment of the seats.

The suspended design of teeter-totter 10 also eliminates pinch points that are common with conventional teeter-totter designs. The spaced-apart legs of support frame 20 further eliminate pinch points near the pivot and between the frame and the rocker beam. The spaced-apart legs also provide a more stable support for the teeter-totter.

Figure 3:
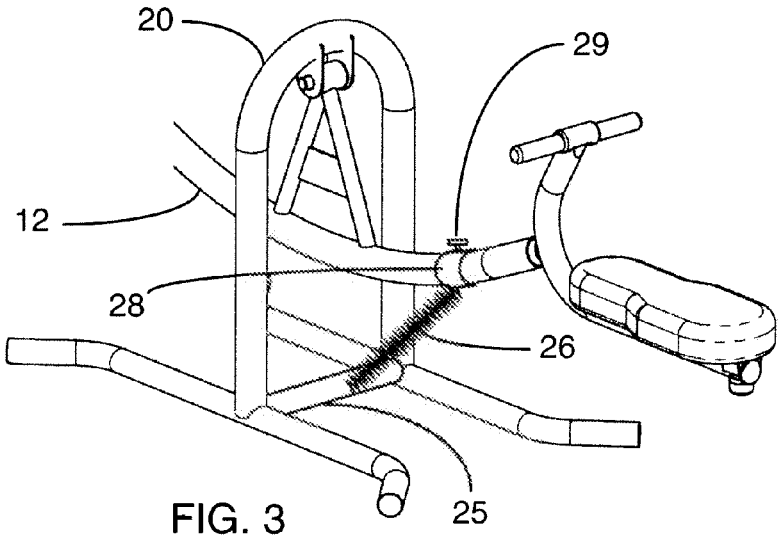
FIG. 3 is a detailed view of a counterbalance mechanism.

Conventional teeter-totters work best when the occupants on each side are of approximately equal weight. Often, however, individuals of unequal weights may wish to play on a teeter-totter. To accommodate this, embodiments of the present invention may include a counterbalance such as shown in FIG. 3. A spring 26 is coupled between an additional frame member 25 and collar 28. The collar may be positioned at a desired location along rocker beam 12 and secured in place by means of locking knob 29. As collar 28 is positioned more outwardly along rocker beam 12, a greater weight differential can be accommodated with the larger individual sitting opposite the spring.

Figure 4:
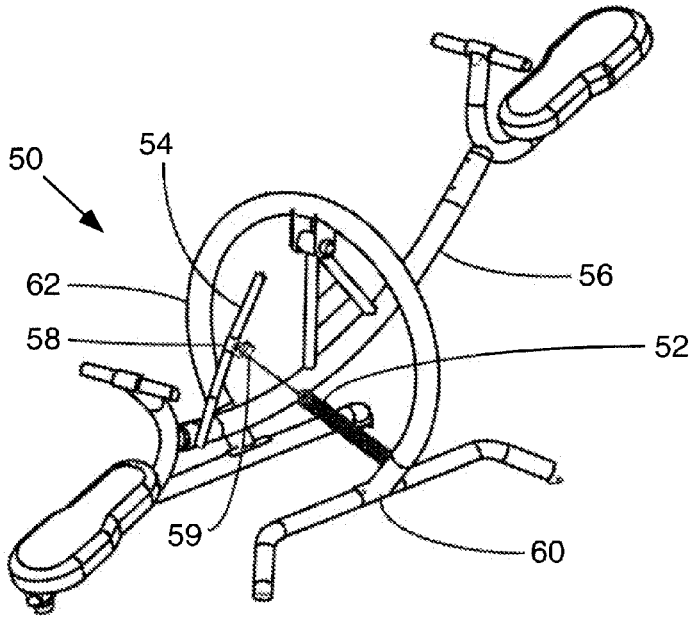
FIG. 4 is a perspective view of an alternative embodiment.

FIG. 4 illustrates an alternative embodiment of a teeter-totter 50 with another counterbalance arrangement. Here, a spring 52 connects between the support frame 60 and a curved arm member 54, which is secured to the rocker beam 56. Arm member 54 is arced as a radius about the point where the spring 52 connects to the support frame 60 and positioned such that one end is closer to pivot 22 and the other end is further from the pivot 22. The spring is secured to collar 58, which can be fixed at a desired position along arm member 54 by means of locking knob 59. This arrangement is easier to adjust since the spring length remains constant as collar 58 is moved along arm member 54.

Other techniques for counterbalancing the teeter-totter may be used. For example, the rocker beam may be constructed with telescoping sections to allow the relative distances of the seats from the pivot to be adjusted. Alternatively, the pivot location along the length of the rocker beam may be made adjustable. Also, an elastic resistance device, such as a bungee cord or rubber cord, may be used instead of a spring as the counterbalance means.

The embodiment illustrated in FIG. 4 also shows an alternative configuration for support frame 60. In this case, the upright portion 62 of the support frame is configured as a circular hoop rather than an inverted "U".

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A teeter-totter comprising:

a pair of longitudinally spaced apart seats;

a longitudinal seat support member having one of the pair of seats disposed at each end thereof;

a support frame transverse to the seat support member having a pivot disposed above the seat support member and wherein the support frame extends downwardly on opposite sides of the seat support member to rest on a supporting surface and wherein the seat support member is pivotally suspended from the pivot below the support frame;

a counterbalance to compensate for users of unequal weight in the seats, wherein the counterbalance comprises a spring coupled between the support frame and an arm member attached to the seat support member;

wherein the spring is coupled to the arm member at an adjustable position along the arm member.

2. The teeter-totter of claim 1 wherein the arm member is curved such that a length of the spring remains constant regardless of where along the arm member the spring is coupled.

3. A teeter-totter comprising:

a pair of longitudinally spaced apart seats;

a longitudinal seat support member having one of the pair of seats disposed at each end thereof, wherein the seat support member comprises a rocker beam and a pair of seat supports attached to respective ends of the rocker beam;

a support frame transverse to the seat support member having at least one pivot, the seat support member being pivotally suspended from the at least one pivot below a top of the support frame, and wherein the support frame comprises a single upright leg portion on at least one side of the seat support member; and a pair of handlebars attached to respective ones of the seat supports.

4. The teeter-totter of claim 3 further comprising a locking mechanism to prevent movement of the seat support member about the pivot.

5. The teeter-totter of claim 4 wherein the locking mechanism comprises a flexible member secured between the seat support member and the support frame.

6. The teeter-totter of claim 3 having a single upright leg portion on each side of the seat support member.

7. The teeter-totter of claim 6 wherein the upright leg portions of the support frame are configured with an inverted "U" shape.

8. The teeter-totter of claim 6 wherein the upright leg portions of the support frame are configured with a hoop shape.

9. The teeter-totter of claim 6 wherein the support frame further comprises a pair of longitudinally extended base members attached to respective ones of the leg portions.

10. The teeter-totter of claim 3 wherein the rocker beam has an upwardly concave arcuate shape in a vertical plane.

11. A teeter-totter comprising:

a pair of longitudinally spaced apart seats;

a longitudinal seat support member having one of the pair of seats disposed at each end thereof, wherein the seat support member comprises a rocker beam and a pair of seat supports attached to respective ends of the rocker beam;

a support frame transverse to the seat support member having at least one pivot, the seat support member being pivotally suspended from the at least one pivot below a top of the support frame, and wherein the support frame comprises a single upright leg portion on at least one side of the seat support member, wherein each of the seat supports is substantially in the shape of a "J".

12. The teeter-totter of claim 11 wherein the rocker beam has an upwardly concave arcuate shape in a vertical plane.

13. The teeter-totter of claim 11 having a single upright leg portion on each side of the seat support member.

14. The teeter-totter of claim 13 wherein the support frame further comprises a pair of longitudinally extended base members attached to respective ones of the leg portions.

15. The teeter-totter of claim 13 wherein the upright leg portions of the support frame are configured with an inverted "U" shape.

16. The teeter-totter of claim 13 wherein the upright leg portions of the support frame are configured with a hoop shape.

17. The teeter-totter of claim 11 further comprising a locking mechanism to prevent movement of the seat support member about the pivot.

18. The teeter-totter of claim 17 wherein the locking mechanism comprises a flexible member secured between the seat support member and the support frame.

* * * * *